United States Patent [19]

Stapenell

[11] 4,454,686

[45] Jun. 19, 1984

[54] PRESSURE-RELIEVING CLOSURE PANEL

[76] Inventor: Ralph H. Stapenell, 4543 Kavan Ct., Doylestown, Pa. 18901

[21] Appl. No.: 426,002

[22] Filed: Sep. 28, 1982

[51] Int. Cl.[3] ..... E05C 15/02

[52] U.S. Cl. ..... 49/141; 49/394; 49/485; 49/495; 220/314

[58] Field of Search ..... 49/141, 394, 31, 485, 49/495; 220/314, 316

[56] References Cited

U.S. PATENT DOCUMENTS

| | | | |
|---|---|---|---|
| 3,339,791 | 9/1967 | De Frees | 220/314 |
| 3,461,517 | 8/1969 | Eisenhard | 49/495 X |
| 3,531,577 | 9/1970 | Garlington | 49/485 X |
| 4,207,706 | 6/1980 | Haines | 49/141 |

*Primary Examiner*—Philip C. Kannan

*Attorney, Agent, or Firm*—Frederick A. Zoda; John J. Kane

[57] ABSTRACT

A panel structure for mounting on any of various enclosures susceptible to explosions or excessive internal pressures, is formed as a self-contained unit mountable in sealing relation to a pressure-relief opening of the enclosure. Disclosed is a one-piece back plate with an integral mounting flange isolating all other frame components from the area in which a sealing function takes place. A peripheral seal on the closure panel exerts pressure against the back plate in a normal position of the closure panel, in a direction parallel to the lines along which internal pressure is exerted against the closure panel, thus providing an efficient seal about the entire periphery of the relief opening, without the necessity of precisely dimensioning the sealing gasket and frame components at the locations where they are interfaced for sealing engagement. The gasket includes side-by-side primary and secondary sealing beads, one of which projects forwardly a distance less than the other. Upon the application of excessive internal pressure, the closure panel moves linearly, initially breaking the primary seal while leaving the secondary seal functional for its intended purpose. Further linear movement of the closure panel ultimately results in disengagement of the secondary seal for full venting of excessive internal pressures developed within the enclosure.

4 Claims, 8 Drawing Figures

PRESSURE-RELIEVING CLOSURE PANEL

BACKGROUND OF THE INVENTION

1. Field of the Invention

The present invention relates generally to the field of panel structures developed for the purpose of providing relief in the event of explosions occurring within a protected enclosure, or for the relief of pressures developing to an excessive degree within said enclosures. In a more particular sense, the invention has reference to an improved panel structure having a peripheral sealing gasket especially designed to react to excessive pressures while they remain at a relatively low value, to vent the enclosure before dangerous, high pressure conditions develop therein.

2. Description of the Prior Art

It is not new, broadly, to provide relief openings in any of various types of enclosures such as, for example, processing towers, retorts, ducts, mixers, and the like. Typically, such enclosures may have relief openings that are normally sealably closed by closure panels designed to move to positions venting the enclosure when dangerous pressure conditions develop therein. Such panels, for example, provide relief in the event of an explosion within the enclosure, or alternatively, may provide relief whenever pressures rise within the enclosure to an extent determined as exceeding a safe level. In U.S. Pat. No. 4,207,706, a closure panel of this type is disclosed, utilizing a linearly movable panel member supported by pivoted arms. The disclosure of that patent is incorporated herein by reference. In that patent, a peripheral sealing gasket is disclosed, in which sealing pressures are exerted against an adjacent rim of a supporting frame in the plane of the panel itself.

The prior art arrangement, while operating satisfactorily, is not thought to react to low pressures, on the order for example of 2 to 3 inches of water, with a high degree of accuracy and repeatability. Yet, in many situations, reactions having this degree of sensitivity are clearly desirable and should be attained if at all possible.

It is important, too, to provide a unitary structure, including a support means that incorporates frame components in such a manner as to permit the entire device to be preassembled and installed as a single unit, with the frame adapted to utilize basic frame elements that will completely isolate all other frame components from the sealing function. This characteristic has been thought lacking in the prior art as exemplified by U.S. Pat. No. 4,207,706, in which the exertion of a sealing pressure in the plane of the closure panel, against a surrounding rim of the frame assembly, does not offer such isolation.

The prior art as typified by the above-designated patent is further lacking in an adaptability for reacting to low pressures while at the same time complying with industry standards relating to strength, resistance to accidental malfunction, and pressure relief values regarded as important in pressure-relieving closure panel structures.

SUMMARY OF THE INVENTION

Summarized briefly, the present invention comprises a unitary pressure-venting device including a support means that comprises a flat back plate rigid with a rectangular, tubular frame of high dimensional and structural integrity. The back plate is adapted to be secured to the wall of an enclosure susceptible to explosions or excessive internal pressures. The back plate is formed with a relief opening through which the excessive pressures may be vented, and normally closing the relief opening is a closure panel supported by a pair of arms hingedly mounted upon the support frame. The closure panel is linearly movable away from a sealing relationship to the relief opening, in the event of an explosion or excessive pressure conditions within the protected enclosure. A magnetic latch normally holds the arms in a position in which the door will be supported in sealing relationship to the back plate. To this extent, the construction is similar to that disclosed in U.S. Pat. No. 4,207,706.

In accordance with the present invention, a peripheral seal is provided upon the closure panel, which exerts its sealing pressure directly against the back plate, in a direction perpendicular to the plane of the closure panel, that is, a direction parallel to the path along which the excessive internal pressures would be exerted against the closure panel from inside the enclosure. The seal includes primary and secondary sealing beads, one of which projects forwardly a distance greater than the other, so that upon the exertion of a pressure tending to linearly shift the closure panel from its normal sealing position, the primary bead will first move out of sealing engagement with the back plate. Further linear movement of the closure panel in the same direction will disengage the secondary bead. This arrangement is effective to produce a precise reaction to pressures lower than those heretofore controlled by closure panel structures such as that disclosed in U.S. Pat. No. 4,207,706.

The construction is such that the sealing action is exerted in direct opposition to springs that normally bias the closure panel to its sealing position, thus reducing the internal pressure within the protected enclosure required to activate a latching device on the support arms.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
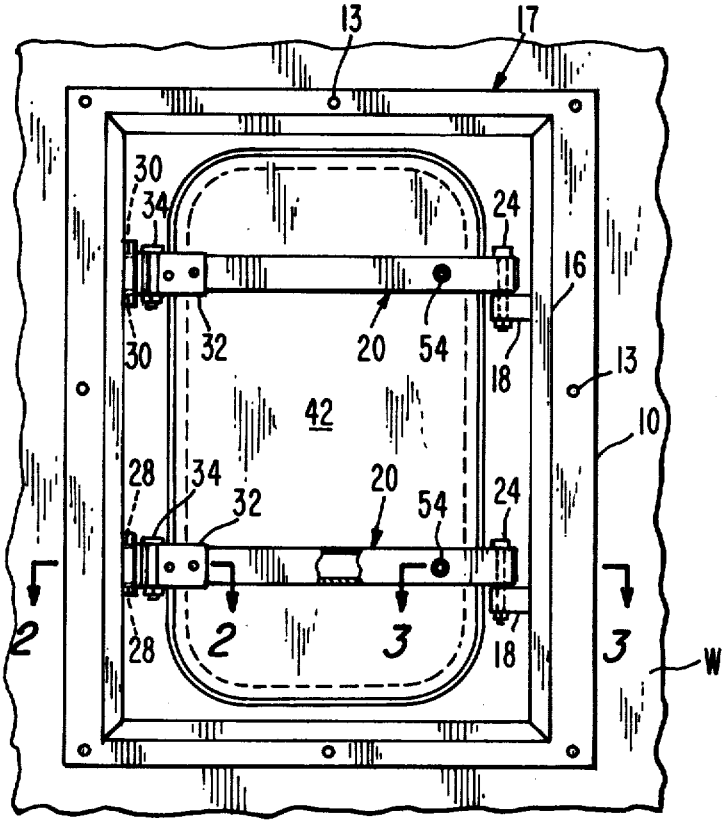
FIG. 1 is an elevational view of a closure panel assembly in accordance with the present invention, the wall of a protected enclosure on which the assembly is mounted being illustrated fragmentarily and in elevation.

In the drawings, there is illustrated as part of the present invention a flat, rigidly constituted back plate 10 formed from steel or other suitably strong metal material. The back plate is mounted in position to extend about a relief opening 11 formed in the wall W of a protected enclosure such as a processing tower, retort, furnace, mixing chamber, or the like. It is common in enclosures of this type that pressures will develop in excess of a prescribed, safe value, and these pressures must be relieved to preclude a catastrophic occurrence such as an explosion or blow-out that might destroy all or part of the installation and, indeed, result in personal injury or loss of life.

The back plate is sealingly, fixedly secured in position extending about the opening 11, through the provision of openings 12 which are spaced about the periphery of the back plate, and which receive rivets 13 or other suitable fastening elements securing the back plate to the wall W.

Figure 2:
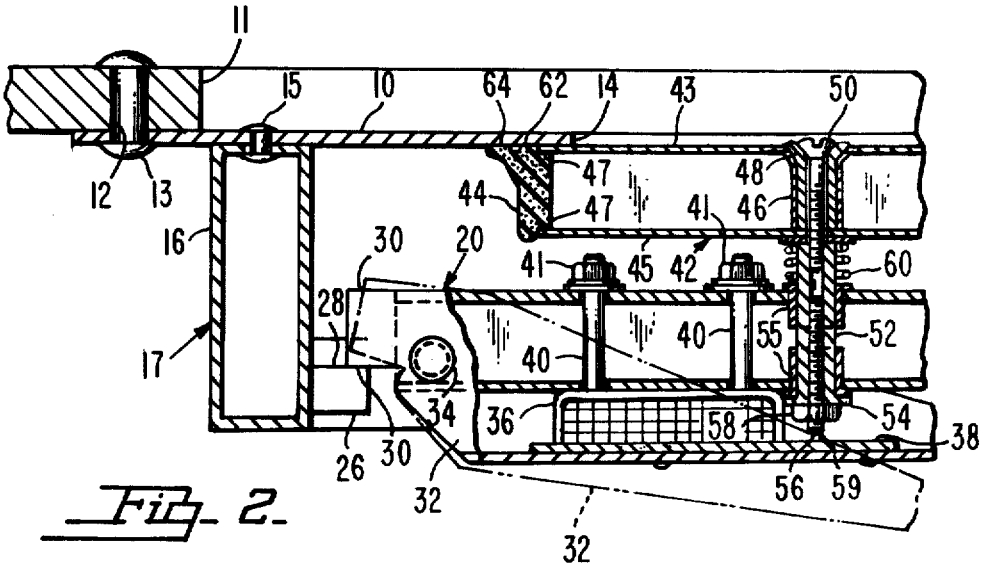
FIG. 2 is an enlarged, fragmentary sectional view through the closure panel structure, taken substantially on line 2—2 of FIG. 1, a magnetic latch being shown in latching and unlatching positions in full and dotted lines respectively.
Figure 3:
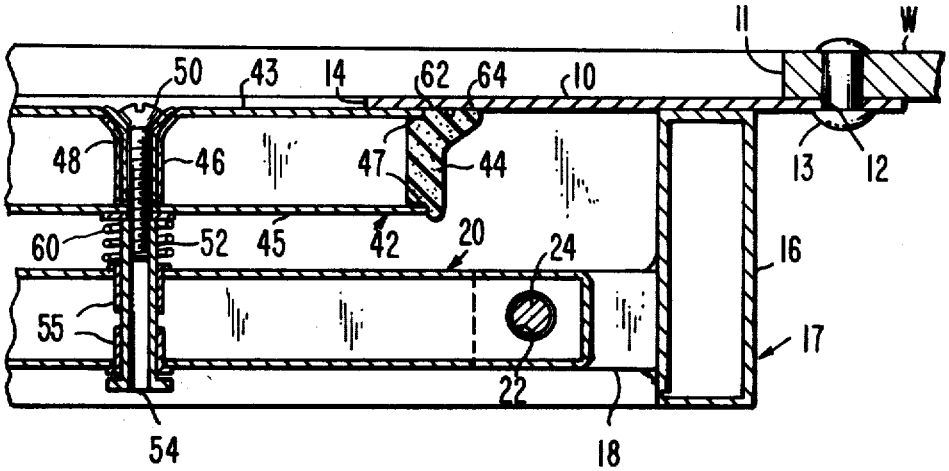
FIG. 3 is a view on the same scale as FIG. 2, taken substantially on line 3—3 of FIG. 1, illustrating the construction at the ends of the support arms that are pivotally attached to the frame means.

Formed in the back plate is a relief opening 14, through which the excessive internal pressures developing within the enclosure are vented when the device constituting the present invention is activated responsive to the development of excessive internal pressures within the enclosure. Spaced outwardly from the opening 14 is a support frame 16, formed as a continuous, tubular member of rectangular cross section as shown in FIGS. 2 and 3, riveted at spaced locations along its length to the back plate as at 15. Frame 16 projects outwardly from the back plate, and with the back plate provides a support means 17 for the arm-and-closure panel assembly incorporated in the invention for the purpose of relieving internal pressures while normally providing an effective seal about the opening 14.

Referring to FIGS. 1 and 3, hinge brackets 18 are spaced vertically of one side of the frame 16, and are rigidly secured in any suitable manner to said frame, as by welding or the like. The hinge brackets 18 support, for pivotal movement, arms 20. Both arms 20 are identically constructed and mounted, so the description of one will suffice for both.

Referring to FIG. 3, arm 20 is formed with a hinge-pin-receiving opening 22, aligned with a similar opening of the associated bracket 18 to receive a hinge pin 24. Arm 20 is thus mounted for horizontal swinging movement between a fully closed position shown in FIG. 3, and a partially open position which permits full venting of the protected enclosure whenever this should become necessary due to the development of excessive internal pressures therein.

Figure 7:
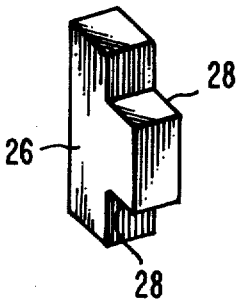
FIG. 7 is a perspective view of a stop block for a keeper.

Referring to FIG. 2, at the other, free ends of the arms, stop blocks 26 are welded or otherwise fixedly secured to the opposite side of the frame 16, as shown in FIGS. 1 and 2. Each stop block is formed, at its opposite ends, with steps 28, providing clearances for extensions 30 formed on a channeled keeper 32. The construction of an individual stop block is illustrated in FIG. 7.

The extensions 30 are normally in the full line position shown in FIG. 2, providing engagement between the extensions 30 and the adjacent wall surfaces of the stepped blocks 26. As a result, the arms 20 are normally retained by the keeper in positions parallel to the plane of the back plate 10, and in these positions, the arms will properly support a closure panel in its normal sealing relationship to opening 14.

Figure 8:
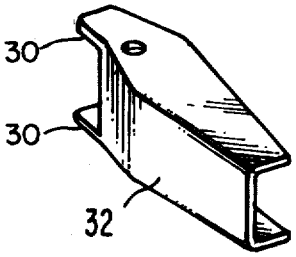
FIG. 8 is a perspective view of the keeper, per se.

The arm 20 is of tubular formation, being of rectangular or box-like cross section, and at the free end of each arm there is provided one of the above-referred-to keepers. Each channeled keeper 32 (see FIG. 8) is of C-shaped cross section disposed, normally, in embracing relation to the distal end of the associated arm 20.

Keeper 32, thus, is normally in the full line position of FIG. 2. It is pivotally connected to the arm 20, through the provision of a pivot pin 34, so that the keeper can swing outwardly relative to the associated arm from the full line position of FIG. 2 to the chain-dotted line position shown in the same figure of the drawing.

Riveted or otherwise permanently attached to the inside of the web of the channeled keeper 32 is a plate 38 of ferrous or other magnetically attractive material, disposed, normally, in engagement with a permanent magnet 36 (preferably ceramic, though this is not absolutely necessary) fixedly secured to arm 20 through the provision of studs 40 extending from the magnet 36 through the arm and receiving nuts 41 (FIG. 2).

The magnet 36 normally attracts the keeper to the full line position shown in FIG. 2, in which position the extensions 30 are disposed in engagement with the associated block 26, to hold the arm in a position parallel to the plane of the opening 14.

The closure panel used for the purpose of sealably closing opening 14 under normal conditions has been generally designated 42. Preferably, it is of a honeycomb construction, and may be formed of aluminum or the like so as to have a desired strength and lightness. In the illustrated example, the honeycomb interior has been omitted since in and of itself it does not comprise part of the present invention. The interior may, however, be formed similarly to that shown on the closure panel in above-mentioned U.S. Pat. No. 4,207,706.

In any event, panel 42 includes opposed front and rear face plates 43, 45 respectively. Extending between the peripheries of the face plates is a resilient sealing gasket 44 preferably of foam silicone rubber or the like. This is adhesively bonded or otherwise fixedly secured to the respective face plates as at 47.

The closure panel is supported by the respective arms 20 for linear movement in respect to said arms. To this end, and referring to FIGS. 2 and 3, connecting post assemblies are provided, spaced longitudinally of each arm 20. Each of these assemblies includes a sleeve 46 extending between the face plates 43, 45, receiving an internally threaded insert or liner 48, in which is threadedly engaged a connecting screw 50. Screw 50 extends rearwardly beyond the rear plate 45, engaging in an elongated, internally threaded post sleeve 52 that extends through the arm 20 and is formed with a head 54. Sleeve 52 is slidable in bushings 55 provided within the arm 20.

The post sleeve 52 adjacent keeper 32 has an adjustment screw 56 threaded therein, provided with a lock nut 58. Screw 56 is threaded into the post sleeve 52 to an extent desired for providing, normally, a selected gap 59 between the end of the screw or threaded element 56 and the keeper 32.

Receiving the post sleeves 52 between the closure panel and arms 20 are compression coil springs 60, which are held under compression to an extent sufficient to bias the closure panel against back plate 10, to resiliently, sealably compress the forwardly projecting portions of the gasket 44.

Figure 6:
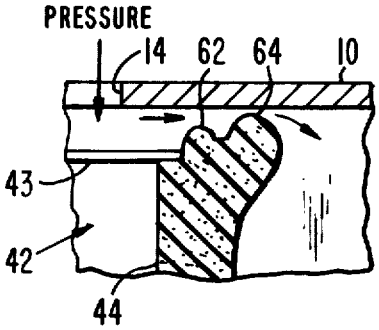

The forwardly projecting portions of the gasket are formed as side-by-side, continuous peripheral inner and outer beads 62, 64 respectively. Bead 62, as shown in FIG. 6, when in its uncompressed condition projects forwardly a distance less than the bead 64. Bead 62 can be termed a primary bead, while bead 64 is a secondary bead.

As shown in FIGS. 2 and 3, under normal conditions the beads 62, 64 are both compressed against the adjacent surface of the back plate 10. The pressure exerted by the beads is along lines parallel to the direction in which pressure would be exerted from within the enclosure against the face plate 43 of the closure panel. No need for precise dimensioning of the contacting faces of the back plate 10 and the gasket 44 relative to each other exists, as distinguished from arrangements in which the peripheral sealing gasket would project outwardly from the closure panel in the plane of the closure panel, that is, normally to the direction in which pressure would be exerted against the closure panel from within the enclosure.

In use, the device first of all can be regarded as a unitary structure, capable of pre-assembly and adapted for mounting as a self-contained, complete unit on wall W of the protected enclosure, merely by application of the fastening means 13 used for sealably, fixedly securing the peripheral portion of the back plate 10 to the wall of the enclosure. The construction of the support means as a back plate 10 having a rearwardly projecting frame 16 is one that allows the back plate to serve as the contact surface for the sealing gasket 44, thus completely isolating all frame components other than the back plate from the sealing function. This is highly desirable, in that as indicated above, it eliminates the need for precise dimensioning of other frame components relative to the sealing gasket.

The frame 16, in and of itself, affords high dimensional and structural integrity, and efficiently serves to support the arms 20 and, indirectly, the closure panel 42.

Operationally, the device is normally positioned as shown in FIGS. 2 and 3. In these circumstances, the force of the springs 60 is exerted against the closure panel in a manner to resiliently compress the beads 62, 64 and in this way provide a seal that is highly effective under normal operating conditions, to maintain internal pressure at a value found desirable for the particular installation. To this end, the sealing pressure exerted by beads 62, 64 against back plate 10 is in direct opposition to the force of the springs 60. Use of the resilient gasket in a plane where its reactions are directly opposed to those of the compression springs 60, together with the use of low friction bushings such as shown, for example, at 55, makes possible the use of a low power magnet 36 and therefore assures that the device will react precisely and efficiently at very low pressures.

Figure 4:
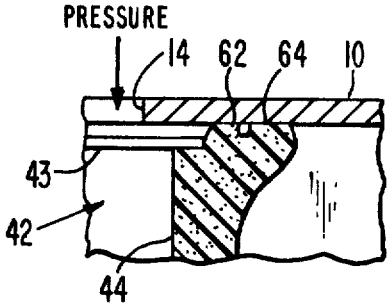
FIGS. 4, 5 and 6 are fragmentary sectional views on the same cutting plane as FIG. 3, showing the closure panel at successively greater distances from the frame against which it is normally in full sealing engagement.
Figure 5:
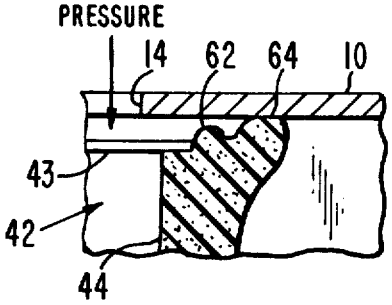

These pressures may be as low as 2 to 3 inches of water, and the reaction is produced, despite the low levels of the reaction pressures, with a high degree of accuracy and repeatability. In this connection, assuming that an excessive internal pressure is developed within the enclosure, this pressure will be exerted along lines shown by the arrows in FIGS. 4, 5 and 6. Initially, the pressure will be exerted against panel 42 to an extent that will force the panel slightly away from back plate 10. This causes primary bead 62 to move outwardly to an extent in which its sealing pressure is first reduced as in FIG. 4 and thereafter rendered non-functional in FIG. 5.

Although to this extent some sealing pressure exerted against the back plate 10 is lost during the initial linear movement of the panel 42 under excessive internal pressures, sealing pressure is still retained until the projecting end of stud 56 engages the keeper 32 and activates the latching device. It is important, thus, that the seal be maintained during this initial linear motion of the door panel from its FIG. 3 position to its FIG. 5 position.

As continued internal pressure is exerted against the door panel 42 due to the maintenance of the seal, the activating stud 56 causes the magnetic attraction between the keeper plate 38 and magnet 36 to be broken, so that the keeper swings to the dotted line position of FIG. 2. This frees the closure panel completely for full movement in its linear path to its pressure-venting position shown in FIG. 6, in which position the panel has moved to an extent to break the seal between bead 64 and back plate 10. The internal pressures are now vented past the seal as shown by the arrows in FIG. 6.

This highly desirable reaction to internal pressures is achieved through the use of a seal which has maximum area when in its full sealing contact with the back plate 10, as shown in FIGS. 2 and 3. This maximum area results from the provision of side-by-side primary and secondary sealing surfaces afforded by the beads 62, 64. Yet, when the closure panel begins to move away from the back plate due to the development of excessive pressures within the enclosure, the seal is still maintained through part of the linear motion until the keeper is activated and shifted to its releasing or unlatching position. This is achieved, in large degree, through the arrangement of the peripheral seal in direct opposition to the forces exerted by the compression coil springs 60. A wide range of adjustments is permitted, to adjust the values of these opposing forces relative to each other, through the provision of their arrangement in direct opposition to each other, taken with the adaptability of adjusting the tension of the springs by means of selectively adjusting the axial distance of the post sleeves 52 from the closure panel, through the provision of the connecting screws 50. The further adjustment of the stud 56, taken with the spring tension adjustment, permits precise establishment of the internal pressures necessary to cause the closure panel to move fully to a venting position. It is by reason of these relative adjustments and the particular form and arrangement of the sealing gasket, that reaction to a wide range of pressures, including pressures as low as those indicated above, is achieved.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a pressure relief apparatus of the type including a support means having a relief opening and adapted for mounting on an enclosure susceptible to the development of excess internal pressure, and further having at least one panel support arm hingedly attached to the support means for movement between normal and pressure-relieving positions, the improvement comprising a pressure relief panel mounted on said arm for limited linear movement in respect thereto from a normal first position closing the opening through a second position to a third, pressure-relieving position spaced from the opening a distance sufficient to relieve the enclosure of excess pressure developing therein, springs compressed between the arm and panel adapted for biasing the panel to its normal closing position, means releasably latching the arm in its normal position, and a resilient gasket on the panel sealably pressed by the force of the springs against the support means in a direction paralleling that in which internal pressure is exerted against the panel, the gasket including side-by-side primary and secondary sealing beads both of which project toward the support means with the primary bead projecting to a lesser extent than the secondary bead, both beads being sealably compressed against the support means in the normal, first panel position in the presence of a predetermined normal pressure within the protected enclosure, the panel being movable to its second position when said normal pressure is exceeded, sufficiently to space the primary bead from the support means while leaving the secondary bead sealably compressed against the support means, the latch means being operable to free the panel for movement to its third position responsive to continued excess internal pressure exerted thereagainst with the secondary bead in its sealing position.

2. In a pressure relief apparatus including a support means having a relief opening and adapted for mounting on an enclosure in which excess internal pressure may develop, and further having at least one panel support arm hinged to the support means for movement between normal and pressure-relieving positions, the improvement comprising: a pressure relief panel mounted on the arm for limited linear movement in respect thereto from a normal first position closing the opening through a second position in which the opening remains closed to a third, open, pressure-relieving position spaced from the opening a distance sufficient to relieve the enclosure of excess pressure; a plurality of springs compressed between the arm and panel and biasing the panel linearly to its first position; a keeper pivotally attached to the arm and movable between a latching position in which the arm retains the panel in its first position, and an unlatching position in which the arm frees the panel to move to its open position, the keeper and arm including separable means normally interengaging to retain the keeper in its latching position; means for adjusting the tension of the springs; a stud on the panel engageable with the keeper for separating said interengaging means and for biasing it to its unlatching position responsive to linear movement of the panel in a direction toward its third position; and resilient primary and secondary sealing beads on the panel both projecting toward the support means and sealably pressed by the force of the springs thereagainst in a direction paralleling that in which internal pressure is exerted against the panel, the beads exerting their force oppositely to the springs, the primary bead projecting to a lesser extent than the secondary bead, both beads being compressed against the support means in the normal, first panel position in the presence of a predetermined normal pressure within the protected enclosure, the panel being linearly movable to its second position, when said normal pressure is exceeded, sufficiently to space the primary bead from the support means while leaving the secondary bead sealably compressed against the support means, the keeper being swingable to its unlatching position by the stud upon further linear movement of the panel to its third position, said beads, springs, and stud exerting their respective forces along linear, parallel paths normal to the general plane of the panel with the stud being adjustable in said linear direction to selectively time the disengagement of the secondary bead from the support means and thereby relieve the excess internal pressure, in respect to the earlier disengagement of the primary bead from the support means.

3. In a pressure relief apparatus the improvement of claim 2 in which the primary and secondary beads are integrally joined to provide a single resilient gasket extending continuously about the relief opening.

4. In a pressure relief apparatus the improvement of claim 2 wherein the primary bead is disposed between the opening and the secondary bead.

* * * * *